US010825377B2

(12) United States Patent
Lee et al.

(10) Patent No.: US 10,825,377 B2
(45) Date of Patent: Nov. 3, 2020

(54) DISPLAY APPARATUS, CONTROL METHOD AND COMPENSATION COEFFICIENT CALCULATION METHOD THEREOF

(71) Applicant: SAMSUNG ELECTRONICS CO., LTD., Suwon-si (KR)

(72) Inventors: Ho-seop Lee, Seongnam-si (KR); Do-young Kwag, Seoul (KR); Tetsuya Shigeta, Suwon-si (KR); Seong-phil Cho, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 161 days.

(21) Appl. No.: 15/843,250

(22) Filed: Dec. 15, 2017

(65) Prior Publication Data

US 2018/0197453 A1 Jul. 12, 2018

(30) Foreign Application Priority Data

Jan. 10, 2017 (KR) ..... 10-2017-0003327

(51) Int. Cl.
*G09G 3/20* (2006.01)
*G09G 3/32* (2016.01)

(52) U.S. Cl.
CPC ..... *G09G 3/2077* (2013.01); *G09G 3/32* (2013.01); *G09G 2310/067* (2013.01);
(Continued)

(58) Field of Classification Search
CPC .... G09G 5/10; G09G 3/32; G09G 2320/0223; G09G 2320/0285; G09G 2320/064;
(Continued)

(56) References Cited

U.S. PATENT DOCUMENTS 7,714,811 B2 5/2010 Kim
2004/0119884 A1* 6/2004 Jiang ..... H04N 7/012 348/448

(Continued)

FOREIGN PATENT DOCUMENTS

JP 5212002 B2 6/2013
KR 10-0646990 B1 11/2006

(Continued)

OTHER PUBLICATIONS

International Search Report (PCT/ISA/210) and Written Opinion (PCT/ISA/237) issued by the International Searching Authority dated Oct. 24, 2017 in counterpart International Application No. PCT/KR2017/006791.

(Continued)

*Primary Examiner* — Bryan Earles
(74) *Attorney, Agent, or Firm* — Sughrue Mion, PLLC

(57) ABSTRACT

A display apparatus, including a display panel which includes a light emitting element, a storage configured to store a plurality of compensation coefficients corresponding to a plurality of gray levels according to a parasitic capacitance of the light emitting element, and a processor configured to obtain a compensation coefficient from the plurality of compensation coefficients based on at least one of a position of a scan line and a gray level of scan data, compensate the gray level of the scan data based on the obtained compensation coefficient, and drive the light emitting element based on the compensated gray level.

8 Claims, 19 Drawing Sheets

(52) U.S. Cl.
CPC ..... *G09G 2320/0219* (2013.01); *G09G 2320/0223* (2013.01); *G09G 2320/0233* (2013.01); *G09G 2320/0242* (2013.01); *G09G 2320/0285* (2013.01); *G09G 2320/064* (2013.01); *G09G 2360/16* (2013.01)

(58) Field of Classification Search
CPC ..... G09G 3/2077; G09G 2320/0219; G09G 2320/0233; G09G 2320/0242; G09G 2360/16
See application file for complete search history.

(56) References Cited

U.S. PATENT DOCUMENTS

| | | | | |
|---|---|---|---|---|
| 2007/0279323 | A1* | 12/2007 | Park | G09G 3/3283 345/55 |
| 2008/0088648 | A1* | 4/2008 | Nathan | G09G 3/3233 345/690 |
| 2008/0180381 | A1 | 7/2008 | Jeong et al. | |
| 2008/0303804 | A1 | 12/2008 | Schmidt et al. | |
| 2014/0292832 | A1* | 10/2014 | Chang | G09G 3/2014 345/690 |
| 2016/0118001 | A1 | 4/2016 | Ahn et al. | |
| 2016/0155373 | A1 | 6/2016 | Jang et al. | |
| 2016/0240128 | A1 | 8/2016 | Kim et al. | |
| 2016/0246430 | A1 | 8/2016 | Wang et al. | |

FOREIGN PATENT DOCUMENTS

| | | | |
|---|---|---|---|
| KR | 10-2011-0063021 | A | 6/2011 |
| KR | 10-1286515 | B1 | 7/2013 |
| KR | 10-2013-0091905 | A | 8/2013 |
| KR | 10-2016-0049166 | A | 5/2016 |
| KR | 10-2016-0064342 | A | 6/2016 |

OTHER PUBLICATIONS

Communication dated Aug. 16, 2019, issued by the European Patent Office in counterpart European Application No. 17891008.9.

* cited by examiner

DISPLAY APPARATUS, CONTROL METHOD AND COMPENSATION COEFFICIENT CALCULATION METHOD THEREOF

CROSS-REFERENCE TO RELATED APPLICATION

This application claims priority from Korean Patent Application No. 10-2017-0003327, filed in the Korean Intellectual Property Office on Jan. 10, 2017, the disclosure of which is incorporated by reference in its entirety.

BACKGROUND

1. Field

Apparatuses and methods consistent with example embodiments relate to a display apparatus, a controlling method and a compensation coefficient calculation method thereof, and more particularly, to a display apparatus including a display panel including self-luminous elements, and a driving method thereof.

2. Description of Related Art

A light emitting diode (LED) is a semiconductor element that converts current into light. Recently, LEDs have been increasingly used as display light sources, automotive light sources, and illumination light sources, Also, an efficient light emitting diode that emits white light can be realized by using a fluorescent material or combining light emitting diodes of various colors.

Parasitic capacitance can form between the p-n junctions of a light emitting diode. However, there is a problem that luminance of a certain region is reduced due to the influence of parasitic capacitance.

SUMMARY

One or more example embodiments provide a display apparatus for compensating for luminance reduction due to parasitic capacitance through the gradation of an input signal, a control method and a compensation coefficient calculation method thereof.

According to an aspect of an exemplary embodiment, there is provided a display apparatus including: a display panel comprising a plurality of light emitting elements; a storage configured to store a plurality of compensation coefficients corresponding to a plurality of gray levels according to a parasitic capacitance of a light emitting element from among the plurality of light emitting elements; and a processor configured to obtain a compensation coefficient from among the plurality of compensation coefficients based on at least one of a position of a scan line and a gray level of scan data, to compensate the gray level of the scan data based on the compensation coefficient, and drive the light emitting element based on the compensated gray level.

The processor may be further configured to raise the gray level of the scan data based on the compensation coefficient, and to control a time for which the current is applied to the light emitting element based on the raised gray level.

In response to the current being applied, the parasitic capacitance of the light emitting element may increase in a form of a time constant, and the plurality of compensation coefficients may be determined based on a plurality of modeled time constants modeled for the plurality of gray levels according to the parasitic capacitance of the light emitting element.

The plurality of light emitting elements may include a plurality of light emitting diodes (LEDs) divided into a plurality of LED areas, the processor may include a plurality of LED drivers for driving the plurality of LED areas, and the processor may be further configured to obtain the compensation coefficient from the storage a gray level of scan data of a first scan line of an LED area from among the plurality of LED areas.

The processor may be further configured to obtain the compensation coefficient from the storage based on a gray level of scan data of a current scan line and a gray level of scan data of at least one previous scan line.

The processor may be further configured to: determine a difference between the gray level of the scan data of the current scan line and the gray level of the scan data of the at least one previous scan line, and in response to the difference being greater than or equal to a threshold value, obtain the compensation coefficient from the storage, and compensate the gray level of the scan data of the current scan line based on the compensation coefficient.

The light emitting element may include a plurality of sub pixels, and the processor is further configured to compensate the gray level of the scan data based on a compensation coefficient corresponding to each of the plurality of sub pixels.

The light emitting element may be a light emitting diode (LED), and the parasitic capacitance is generated in a P-N junction within the LED.

According to an aspect of another example embodiment, there is provided a method of obtaining a compensation coefficient of a light emitting element from among a plurality of light emitting elements of a display panel, the method including: determining an output luminance of a test image displayed on the display panel; modeling a parasitic capacitance of the light emitting element from among the plurality of light emitting elements for a plurality of gray levels based on a gray level of the test image and the output luminance; and determining a compensation coefficient for compensating for a luminance reduction based on the modeled parasitic capacitance.

The parasitic capacitance of the light emitting element may increase in a form of a time constant in response to a current being applied to the light emitting element, the modeling the parasitic capacitance may include modeling a plurality of time constants according to the parasitic capacitance of the light emitting element corresponding to a plurality of gray levels of an input signal, and the determining the compensation coefficient may include determining the compensation coefficient according to the time constant based on the modeled plurality of time constants.

The light emitting element may include a red light emitting diode (LED), a green LED, and a blue LED, the modeling of the parasitic capacitance may include modeling a time constant according to the parasitic capacitance charged in an LED of a scan line displaying the test image according to application of a current, and the determining the compensation coefficient may include determining the compensation coefficient with respect to a gray level of the scan line based on the modeled time constant.

According to an aspect of another example embodiment, there is provided a method of controlling a display apparatus which stores a plurality of compensation coefficients corresponding to a plurality of gray levels based on a parasitic capacitance of a light emitting element from among a plurality of light emitting elements included in a display panel, the method including: obtaining a compensation coefficient for compensating a gray level of scan data based on at least one of a position of a scan line and a gray level of scan data; and compensating the gray level of the scan data based on the compensation coefficient.

The compensating the gray level of the scan data may include: raising the gray level of the scan data based on the compensation coefficient; and controlling a time for which a current is applied to the light emitting element based on the raised gray level.

The parasitic capacitance of the light emitting element may increase as a time constant in response to a current being applied, and wherein the compensation coefficient for the gray level is calculated based on a modeled time constant obtained by modeling the time constant for a plurality of gray levels of an input signal according to the parasitic capacitance of the light emitting element.

The plurality of light emitting elements may include a plurality of light emitting diodes (LEDs) divided into a plurality of LED areas, the plurality of LED areas may be driven by a plurality of LED drivers, and the gray level of the scan data may correspond to a first scan line of an LED area of the plurality of LED areas.

The obtaining the compensation coefficient may further include obtaining the compensation coefficient based on a gray level of scan data of a current scan line and a gray level of scan data of at least one previous scan line.

The method may further include: determining a difference between the gray level of the scan data of the current scan line and the gray level of the scan data of the at least one previous scan line; and in response to the difference being greater than or equal to a predetermined threshold value, acquiring the compensation coefficient.

The light emitting element may include a plurality of sub pixels, and the compensating the gray level of the scan data may include compensating the gray level of the scan data based on a compensation coefficient corresponding to each of the plurality of sub pixels.

The light emitting element may be a light emitting diode (LED), and the parasitic capacitance may be generated in a P-N junction within the LED.

BRIEF DESCRIPTION OF THE DRAWINGS

The above and/or other aspects will become more apparent from the following description of example embodiments, taken in conjunction with the accompanying drawings, in which.

DETAILED DESCRIPTION

Hereinafter, example embodiments will be described in detail with reference to the accompanying drawings.

Herein, the term "and/or" includes any and all combinations of one or more of the associated listed items. Also, expressions such as "at least one of," when preceding a list of elements, modify the entire list of elements and do not modify the individual elements of the list.

Figure 1:
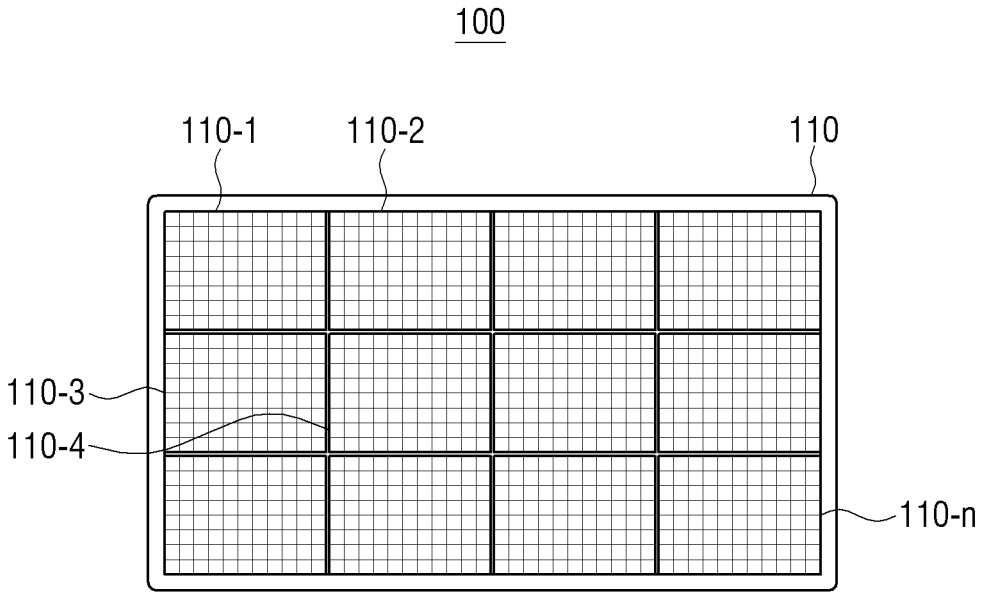
FIG. 1 is a diagram illustrating a configuration of a display apparatus according to an example embodiment.

FIG. 1 is a diagram illustrating a configuration of a display apparatus according to an example embodiment.

According to the illustration in FIG. 1, a display apparatus 100 according to an example embodiment may be realized in the form of the display apparatus 100 includes a display panel 110 including a plurality of display modules 110-1, 110-2, 110-3, 110-4, . . . , **110-*n* which are physically connected to each other. In this example, each of the plurality of display modules 110-1, 110-2, 110-3, 110-4, . . . , 110-*n* may include a number of pixels arranged in a matrix form, for example, self-luminous pixels. Specifically, each of the display apparatus modules 110-1, 110-2, 110-3, 110-4, . . . , 110-*n*** may be implemented as an LED module in which each of a number of pixels is realized as an LED pixel, or an LED cabinet in which a plurality of LED modules are connected to each other, but the example is not limited thereto. For example, a display module may be realized as a liquid crystal display (LCD), an organic LED (OLED), an active-matrix OLED (AMOLED), a plasma display panel (PDP), and the like. However, hereinafter, it will be described such that each display module is realized as an LED cabinet for the convenience of explanation.

The LED is an optical semiconductor element which converts electrical energy to light energy. The LED is a kind of p-n junction diode. A principle of light generation includes electrons in an n region moving to a p region by current supplied from the outside. After electrons and holes recombine in the p-n junction, the electrons are reduced to their base state and emit energy or light. In this example, the wavelength band of the emitted light is formed based on the energy band value, and the color of light is determined based on the wavelength.

In example embodiments, the LED internal p-n junction may be formed of an ion layer, and the ion layer forms an insulator between the p-type semiconductor and the n-type semiconductor to form a parasitic capacitance between the p-n junctions. For example, the parasitic capacitance generated by LEDs can appear in two forms. When reverse bias is applied, the deletion capacitance is mainly caused by the increase of the depletion region, and when forward bias is applied, the charge storage capacitance is mainly caused by the electrolytic accumulation effect inside the LED. For convenience of explanation, examples in which the LED forward bias is applied among the two parasitic capacitances is considered in this specification. The charge accumulation capacitance due to the forward bias has a characteristic of being increased by the forward voltage.

When current is applied to the LED, the parasitic capacitance charged in the LED of a certain scan line will then affect the LED of at least one scan line. In the case of the LED of the first scan line in which the current is first applied, there is a problem that the brightness is darker than the LEDs of other scan lines. This also occurs in the scan period in which the gradation of the input signal (or input image)

changes rapidly. Hereinafter, various example embodiments for reducing the phenomenon will be described with reference to the drawings.

Figure 2A:
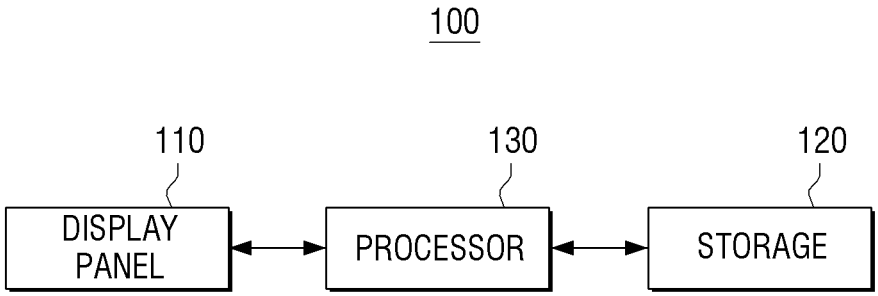
FIGS. 2A and 2B are block diagrams illustrating a configuration of a display apparatus according to an example embodiment.
Figure 2B:
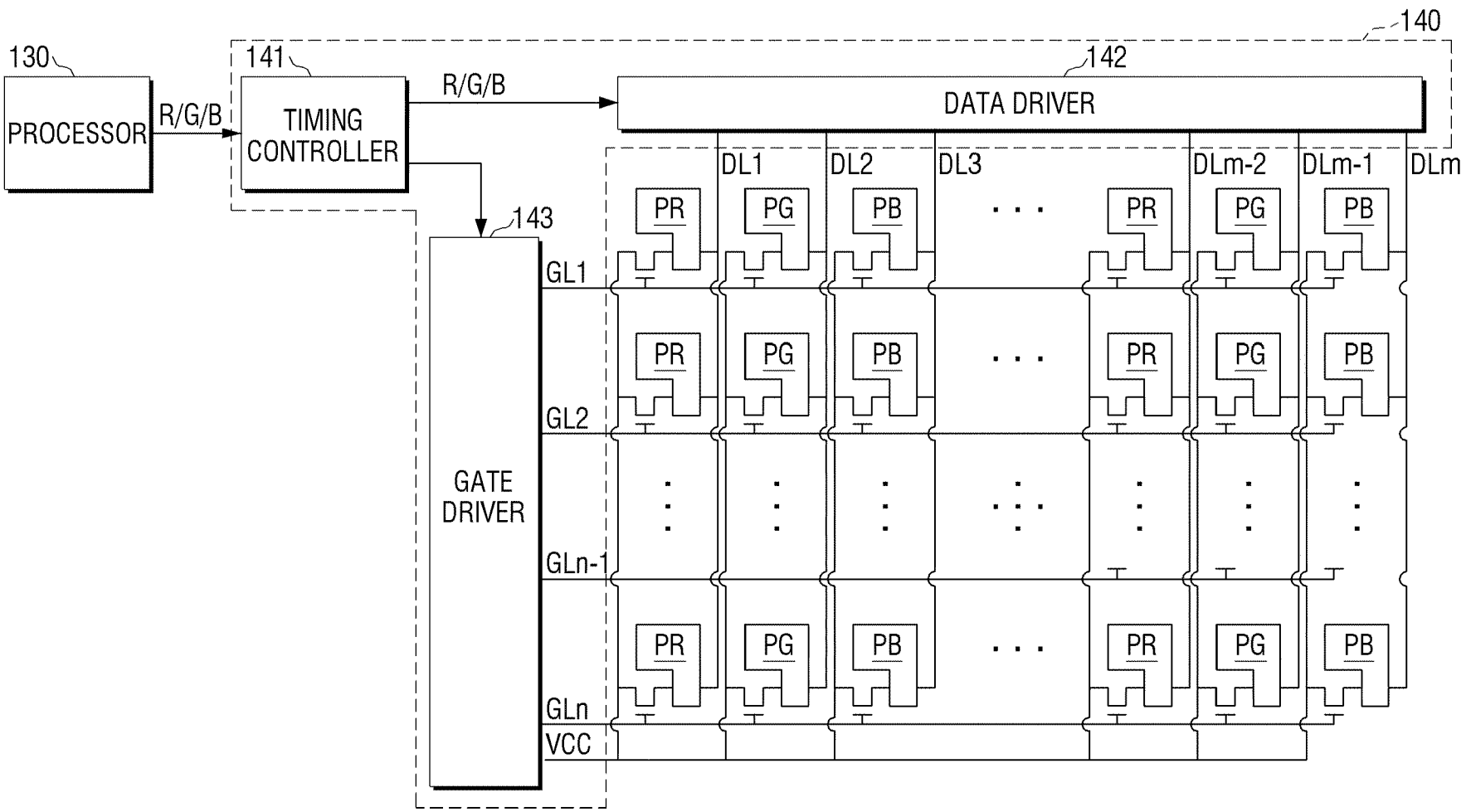

FIGS. 2A and 2B are block diagrams illustrating a configuration of a display apparatus according to an example embodiment.

According to FIG. 2A, the display apparatus 100 includes a display panel 110, a storage 120, and a processor 130.

The display apparatus 110 includes a plurality of display modules. Specifically, the display panel 110 may be formed such that at least one display module, for example, display modules 110-1, . . . , **110-*n*** (n≥1), are connected to each other and assembled. In this example, each of the plurality of display modules may include a number of pixels arranged in a matrix form, for example, self-luminous pixels.

According to an example embodiment, the display panel 110 may be realized as a plurality of LED modules (each LED module including at least one LED element) and/or a plurality of LED cabinets. In addition, the LED module may include a plurality of LED pixels. For example, the LED pixel may be realized as an RGB LED, and the RGB LED may also include a red (R) LED, a green (G) LED, and a blue (B) LED. However, in some example embodiments, the display panel 110 may be also realized as one display module.

The processor 130 drives the display panel 110. In this case, the processor 130 may be implemented to include an analog driver IC or a digital driver IC for panel driving. In particular, if the processor 130 is implemented as a DSP, the processor 130 may be implemented in the form of one chip with a digital driver IC.

However, for convenience of description, hereinafter, it is assumed that the panel driver 140 is implemented separately from the processor 130.

The panel driver 140 drives a display panel 110 according to a control of the processor 130. For example, the panel driver 140 applies a driving voltage or drives a driving current to drive each self-luminous element, for example, LED pixel, included in the display panel 110 according to a control of the processor 130, to thereby drive each LED pixel.

FIG. 2B is a block diagram illustrating details of the display apparatus in FIG. 2A, according to an example embodiment. Description of some elements of FIG. 2B overlapped with the elements of FIG. 2A is omitted below.

The display panel 110 is formed so that the gate lines GL1 to GLn and the data lines DL1 to DLm intersect with each other, and that R, G, and B sub-pixels PR, PG, and PB are formed in the intersections thereof. The adjacent R, G, and B subpixels PR, PG, and PB form one pixel. That is, each pixel includes an R subpixel PR representing red R, a G subpixel PG representing green G, and a B subpixel PB representing blue B, and thereby the color of the object is reproduced in three primary colors of red (R), green (G), and blue (B).

The panel driver 140 may include a timing controller 141, a data driver 142, and a gate driver 143.

The timing controller 141 may receive an input signal IS, a horizontal synchronizing signal Hsync, a vertical synchronizing signal Vsync and a main clock signal MCLK from the outside, and generate an image data signal, a scanning control signal, a data control signal, a data control signal, a light emission control signal, and the like to the display panel 110 and provide the generated signals to the display panel 110, the data driver 142, the gate driver 143, and the like.

The data driver 142 may generate a data signal. The data driver 142 receives image data of an R/G/B component from the processor 130 and generates a data signal. The data driver 142 applies data signals generated in connection with the data lines DL1, DL2, DL3, . . . , DLm of the display panel 110 to the display panel 110.

The gate driver 143 (or scan driver) may generate a gate signal (or scan signal). The gate driver 143 is connected to the gate lines GL1, GL2, GL3, . . . , GLn) to transmit the gate signal to a column of the display panel 110. The data signal output from the data driver 142 is transmitted to the pixel to which the gate signal is transmitted.

Referring back to FIG. 2B, the panel driver 140 may control the brightness of the light source, that is, the LED element, using pulse width modulation (PWM) in which a duty ratio is variable, or control the brightness of the LED element by varying the intensity of the current. Here, the PWM controls the ratio of lighting and lights-out of the light sources, and the duty ratio (%) thereof is determined according to the dimming value input from the processor 130.

The panel driver 140 may be implemented with a plurality of LED driving modules. According to example embodiments, each of a plurality of LED driving modules may include a sub processor for controlling an operation of each display module and a driving module to drive each display module according to a control of the sub processor. In example embodiments, each sub processor and driving module may be embodied as hardware, software, firmware and/or an integrated chip (IC). According to an example embodiment, each sub processor may be a separate semiconductor IC.

Each of the plurality of LED driving modules may include at least one LED driver to control a current applied to the LED element. The LED driver may be included in each of a plurality of LED areas including a plurality of LED elements. In this example, the LED area may be an area that is smaller than the LED module mentioned above. For example, one LED module may be divided into a plurality of LED areas including the predetermined number of LED elements, and each of the plurality of LED areas may include an LED driver. In this example, a current control may be performed for each area. However, the example is not limited thereto, and the LED driver may also be included on an LED module basis.

According to an example embodiment, the LED driver may be disposed at the rear end of the power supply and receive a voltage from the power supply. However, according to another example embodiment, the LED driver may receive a voltage from a separate power supply device. Alternatively, in example embodiments it is also possible that the switch mode power supply (SMPS) and the LED driver are realized in the form of one integrated module.

The LED driver according to one example embodiment may use a PWM method which controls brightness by adjusting a width of frequency. That is, the LED driver may express various gray levels of an image using a dimming method which adjusts the width of a frequency.

Figure 3:
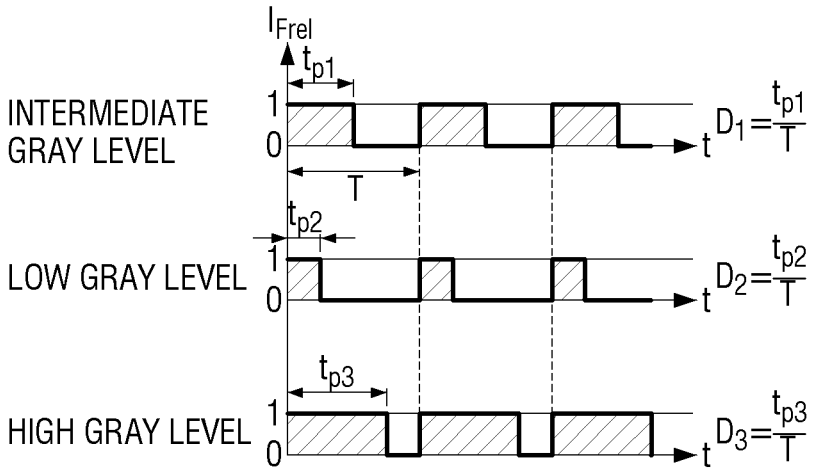
FIG. 3 is a diagram illustrating an LED dimming method according to an example embodiment.

FIG. 3 is a diagram to illustrate an PWM dimming method according to an example embodiment.

Referring to FIG. 3, when implementing a gray level of an input signal, the same predetermined current ($I_{FREL}$) is applied to each pixel and a current application duty (D) that is, current application time ($t_p$), is controlled to be different per gradation of each pixel in a predetermined time interval (T), and thereby the gradation of the corresponding pixel is expressed. In this example, the current application time in a predetermined time interval may be realized as a continuous application time or the sum of non-continuous application time. In this example, a predetermined current is determined based on the characteristics of a plurality of light emitting elements included in the display panel 110 when the corresponding display apparatus 100 is manufactured.

For example, as illustrated in FIG. 3, high-gradation pixels may adjust the current application time to be relatively long, while low-gradation pixels may shorten the current application time during a predetermined dimming interval. However, in some example embodiments, an analog dimming method of adjusting the intensity of the current according to the gradation of the input signal may be used.

Referring back to FIG. 2A, the storage 120 stores various data required for operation of the display apparatus 100.

For example, the storage 120 may be an internal memory such as a read-only memory (ROM), a random access memory (RAM) included in the processor 130, or a memory separate from the processor 130. In example embodiments, the storage 120 may be a memory embedded in the display apparatus 100, or may be a memory that may be detached from the display apparatus 100 according to the usage of data storage.

For example, data for driving the display apparatus 100 may be stored in a memory embedded in the display apparatus, and data for an extension function of the display apparatus 100 may be stored in a memory that may be detached from the display apparatus 100. The memory embedded in the display apparatus 100 may be a non-volatile memory, a volatile memory, a hard disk drive (HDD), a solid state drive (SDD), or the like, and the memory that may be detached from the display apparatus 100 may be a memory card (e.g., a micro secure digital (SD) card or a universal serial bus (USB) memory), an external memory that is connectable to a USB port (e.g., a USB memory), and the like.

In particular, the storage 120 stores a compensation coefficient for compensating for the luminance unbalance due to the parasitic capacitance of the light emitting element. For example, the compensation coefficient for each gray level for compensating the luminance unbalance according to the parasitic capacitance of the light emitting element may be stored.

Here, the compensation coefficient for each gray level may be a compensation coefficient calculated for each gray level based on the modeled time constant generated by modeling the time constant $\tau$ for each gray level of the input signal according to the parasitic capacitance of the light emitting element. Here, the x-axis defining the time constant may be a scan line, and the y-axis can be a parasitic capacitance accumulated in each scan line.

In general, the time constant $\tau$ refers to a constant that is used to determine the state of a phenomenon in a transient period until an output signal reaches a normal state when an input signal to an electric circuit is changed. An example is illustrated in FIG. 4.

Figure 4:
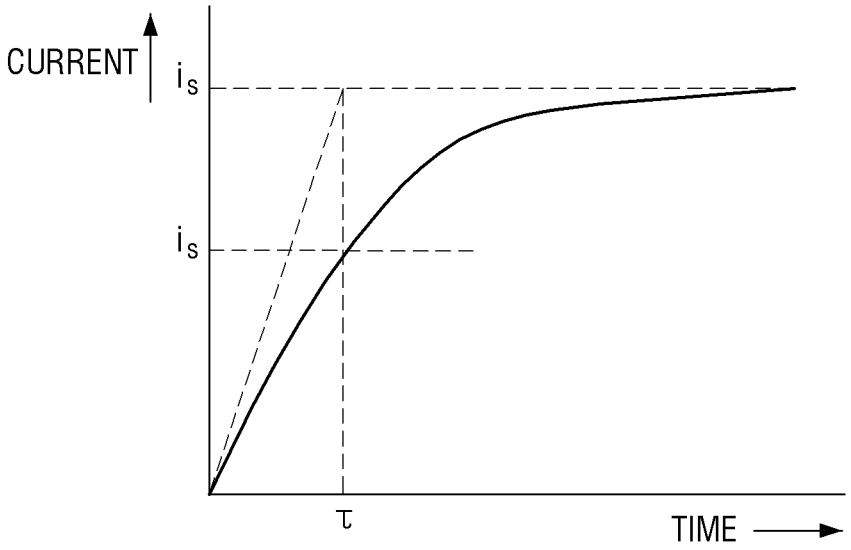
FIG. 4 is a diagram illustrating a form of a time constant according to an example embodiment.

According to the example shown in FIG. 4, when the current ($i_s$) is applied, the parasitic capacitance of the light emitting element of each scan line has a characteristic of being increased in the form of a time constant $\tau$ as shown in FIG. 4. That is, when the current starts to be applied to the first scan line, the parasitic capacitances of the respective light emitting elements increase in the form of the time constant $\tau$ in the order of the first scan line, the second scan line, the third scan line, and reach a normal state in a specific scan line (for example, the fourth scan line), so that each light emitting element in the scan line after a certain scan line has a parasitic capacitance in a normal state.

Here, the case where the current is applied to the first scan line may be a case where a current is applied to the first scan line in the LED area driven by one LED driver, for example. In addition, the case may be a case where a current is not applied (for example, gray level 0) up to the previous scan line according to the gray level of the input signal and a current is applied (for example, gray level 255) to a specific scan line.

On the other hand, the parasitic capacitance accumulated in each scan line affects at least one scan line thereafter.

Figure 5:
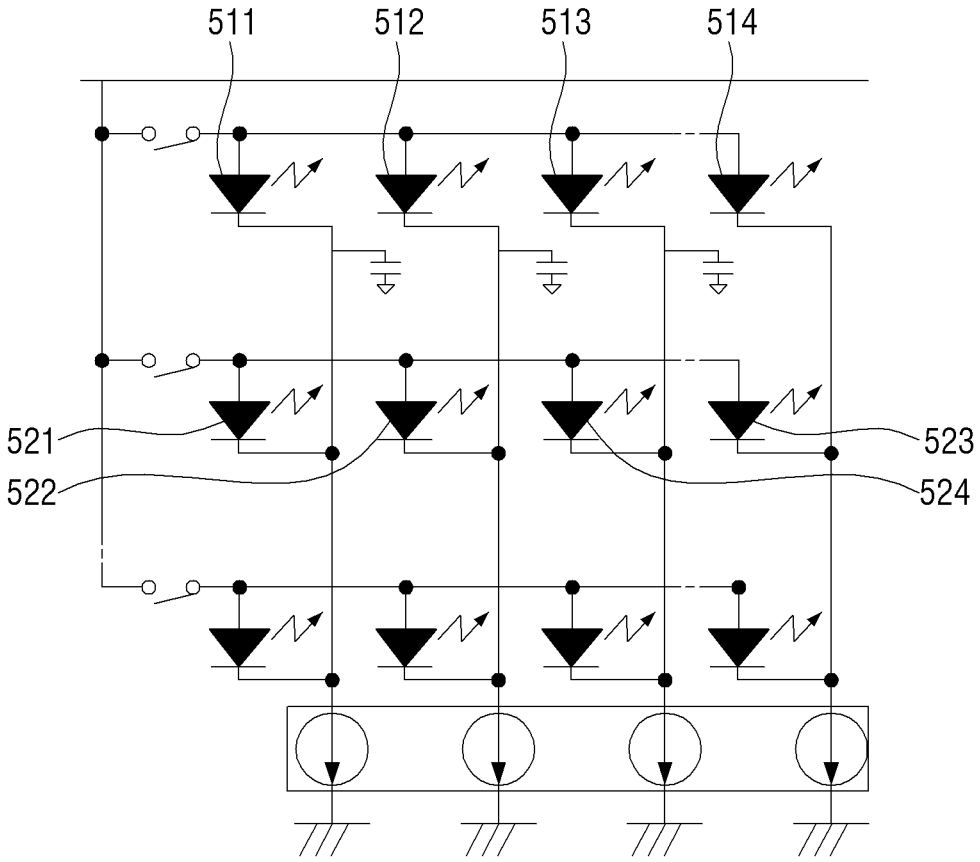
FIGS. 5, 6, and 7 are diagrams illustrating an influence of a parasitic capacitance according to an example embodiment.

For example, in the LED panel structure illustrated in FIG. 5, the parasitic capacitance generated in each LED of LEDs 511, 512, 513 and 514 of a first scan line affects at least each LED of LEDs 521, 522, 523 and 524 of a second scan line. That is, even if the same current is applied, each LED of the second scan line emits light with relatively brighter brightness than each LED of the first scan line due to the parasitic capacitance generated in each LED of the first scan line.

Figure 6:
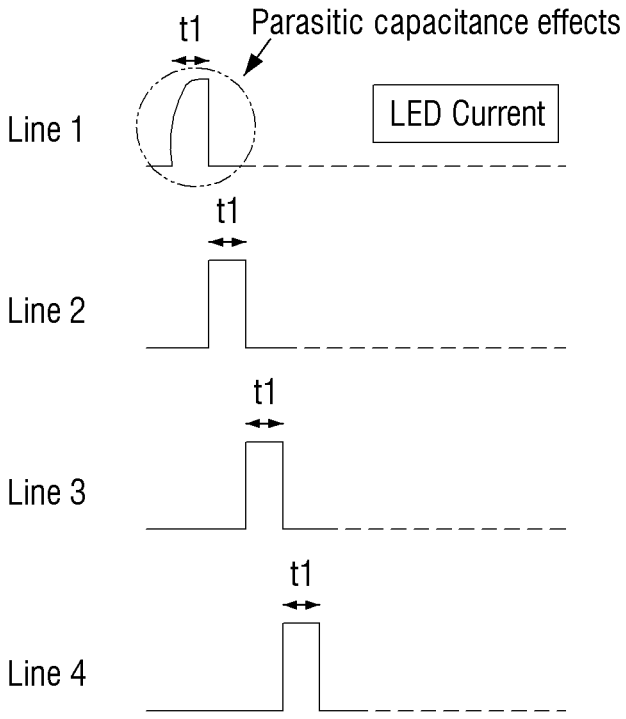

For example, as illustrated in FIG. 6, the LED of the first scan line (line 1) receives a relatively small current during the dimming time t1 because the output signal reaches the normal state based on the time constant, but the LED of the second scan line receives a relatively larger current than the LED of the first scan line due to the parasitic capacitance generated in the LED of the previous scan line. Accordingly, the LED of the first scan line emits light with a darker brightness than the LED of the other scan lines.

Here, the first scan line may be the first scan line of the LED pixel region corresponding to one LED driver. That is, this phenomenon occurs due to the hardware structure.

Similar phenomena are also caused by the gray level of the input signal (or the input image).

Figure 7:
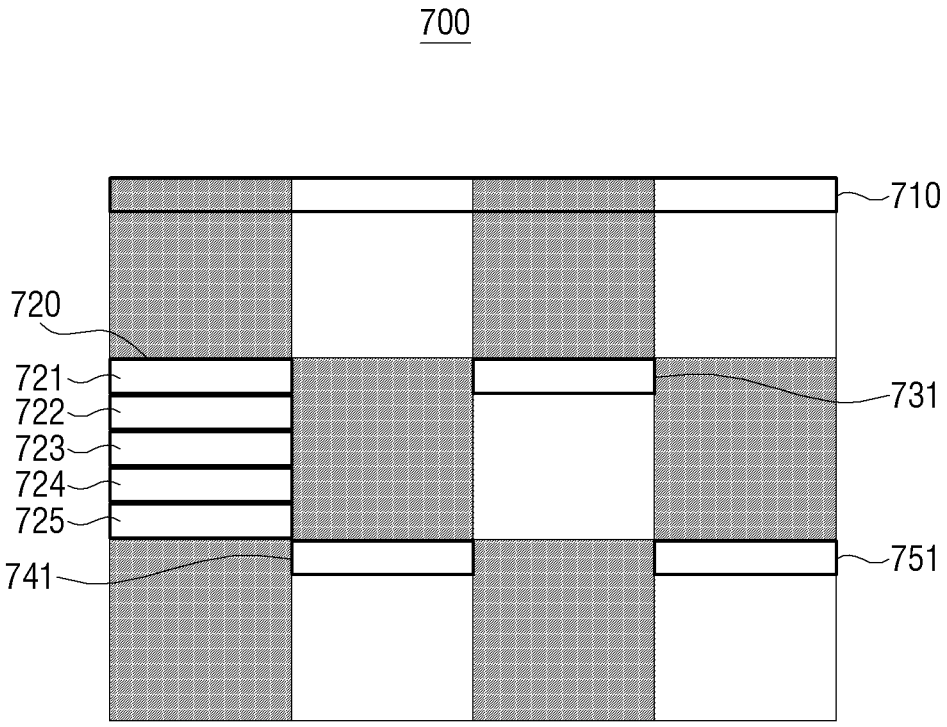

For example, as illustrated in FIG. 7, an area 710 corresponding to the first scan line in the LED pixel area 700 corresponding to one LED driver is illuminated with darker brightness than the LEDs of the remaining scan lines having the same gray level due to the above-described hardware structure.

However, in the LED pixel area 700 corresponding to one LED driver, not only the first scan line 710 but also other portions emit light with darker brightness than the LEDs of the remaining scan lines having the same gray level due to the gray level characteristics of the image.

In some example embodiments, the corresponding LED pixel area 700 includes a dark gray level area and a bright gray level area, and suddenly changes from a dark gray level to a bright gray level in the scan line direction. In the bright gray level area 720, the current is suddenly applied in the area 721, for example, the first scan line of the bright gray level area 720. Thus, the LED of the scan line emits light with a darker brightness than the LEDs of the remaining scan lines 722, 723, 724, and 725 in the same gray level area.

That is, even if the panel driver 140 applies the same current for the same time to the first to fifth scan lines 721, 722, 723, 724, and 725 of the same gray level, the LED of the first scan line 721 emits light at a darker luminance than the LEDs of the remaining scan lines.

Because the current is suddenly applied even in the areas 731, 741, and 751, the LEDs emit light with darker brightness than the LEDs of the remaining scan lines having the same gray level. That is, because the areas 721, 731, 741, and 751 are not affected by the parasitic capacitance accumulated before, relatively less current is applied than other scan lines having the same gray level.

Accordingly, according to an example embodiment, it is possible to perform luminance compensation by adjusting the gray level of an image displayed on an area having a dark brightness due to a hardware structure of the panel or a gray level characteristic of an input signal, that is, a scan line having a dark brightness. In addition, a compensation coefficient for compensating the gray level of the image is calculated in advance and stored in the storage 120. An example method of calculating the compensation coefficient for compensating the gray level of the image is described below.

In addition, the storage 120 may store a luminance correction coefficient for each pixel, information on a binning group, information on a maximum luminance per pixel, information on a color per pixel, and the like. In this example, the binning group may be a group of LED pixels having the same characteristics (luminance, color coordinate, etc.) as much as possible for LED pixels.

For example, in order to match the maximum luminance to the target luminance to a uniformity characteristic between a plurality of LED pixels, the luminance is adjusted down through calibration using a luminance correction coefficient. In this example, the luminance correction coefficient may be in a 3×3 matrix form to realize the target R/G/B luminance, and it is possible to implement uniformity by applying different luminance correction coefficients to each pixel so that the maximum luminance becomes the target luminance. In addition, the target luminance may be implemented based on parameters in a 3×3 matrix form corresponding to each of the R/G/B device, and a color temperature may be also calibrated to have uniformity.

In addition, the storage 120 may also store information on the number of pixels included in each of a plurality of display modules, the size of pixels, and interval between pixels.

According to another example embodiment, the above-mentioned information (for example, compensation coefficient) stored in the storage 120 may not be stored in the storage 120, but may be acquired from an external device. For example, some information may be received from an external device, such as a set-top box, external server, user terminal, and the like, in real time.

The processor 130 controls overall operations of the display apparatus 100. The processor 130 may include one or more of a central processing unit (CPU), controller, application processor (AP), communication processor (CP), ARM processor, or the like.

In addition, the processor 130 may include a graphic processing unit to perform graphic processing corresponding to the image. The processor 130 may be implemented as a system on chip (SoC) including a core and a GPU. The processor 130 may include a single core, dual core, triple core, quad core, and multiples of cores.

The processor 130 may obtain the compensation coefficient from the storage 120 based on at least one of the position of the scan line and the gray level of the scan data and compensate the gray level of the scan data based on the obtained compensation coefficient.

Here, the compensation coefficient for each gray level may be a compensation coefficient calculated based on a modeled time constant generated by modeling the time constant $\tau$ for each gray level of the image according to the parasitic capacitance of the light emitting element.

The processor 130 may compensate for the gray level of the scan data displayed in the first scan line according to the hardware structure or a specific scan line according to the gray level of the input signal. Specifically, the processor 130 may obtain the corresponding compensation coefficient based on the gray level of the scan data of the first scan line according to the hardware structure or the gray level of the input signal from the storage 120 and compensate for the gray level of the scan data based on the obtained compensation coefficient.

For example, the processor 130 may obtain a compensation coefficient from the storage 120 based on the gray level of the scan data of the first scan line of each of the plurality of LED areas driven by each of a plurality of LED drivers. Subsequently, the processor 130 may compensate for the gray level of the corresponding scan data based on the obtained compensation coefficient. However, it is needless to say that the gray level of the scan data can be compensated not only for the first scan line but also for at least one subsequent scan line, for example, the second scan line.

As another example, the processor 130 may obtain the compensation coefficient from the storage 120 based on the gray level of the scan data of each of the current scan line and at least one of the previous scan lines and compensate the gray level of the scan data based on the obtained compensation coefficient.

Specifically, in an example in which a difference in gray level of the scan data of each of the current scan line and at least one previous scan line is greater than or equal to a predetermined threshold value, the processor 130 may obtain a compensation coefficient from the storage 120.

For example, if the scan data of gray level 0 is displayed up to the previous scan line based on the 8-bit image, and the scan data of gray level 255 is displayed from the current scan line, the current scan line may be darkened because there is no accumulated parasitic capacitance to the previous scan line. Therefore, the compensation coefficient corresponding to the scan data of the current scan line may be obtained to compensate the gray level of the current scan line.

When the gray level of the scan data is compensated, the processor 130 may adjust a current application duty applied to the LED based on the compensated gray level and adjust the current application time. In this example, the current application time in a predetermined time interval may be a continuous application time or the sum of non-continuous application time.

Figure 8A:
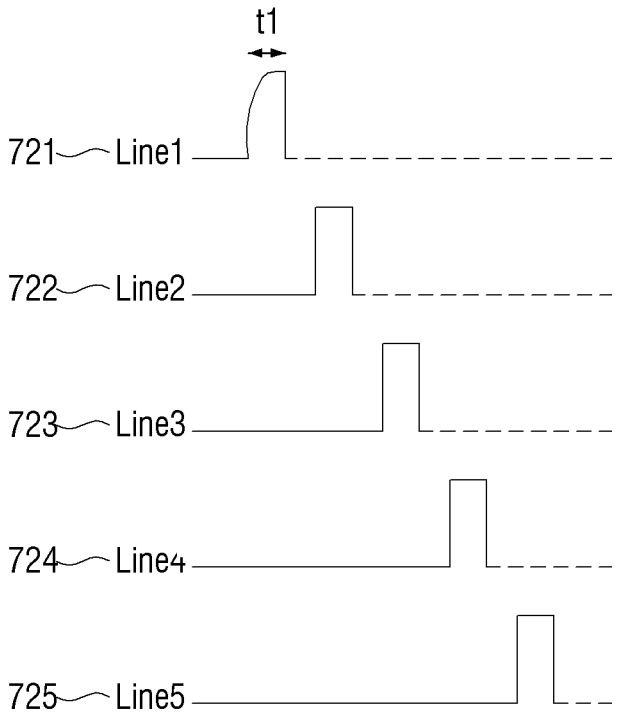
FIGS. 8A and 8B are diagrams illustrating a gray level compensation method of an image according to an example embodiment.

For example, in the image illustrated in FIG. 7, when the brighter gray level area 720 includes five scan lines 721, 722, 723, 724, and 725, the current applied to each of the scan lines 721, 722, 723, 724, and 725 may have the form as illustrated in FIG. 8A. As can be seen in the example of FIG. 8A, a relatively low current is applied to the LED of the first scan line 721. Accordingly, the image of the first scan line 721 is displayed with a darker brightness than the images of the other scan lines 722 to 724.

In this example, the processor 130 may adjust the gray level of the image displayed in the first scan line 721 to have the same brightness as the images of the other scan lines 722 to 724.

Figure 8B:
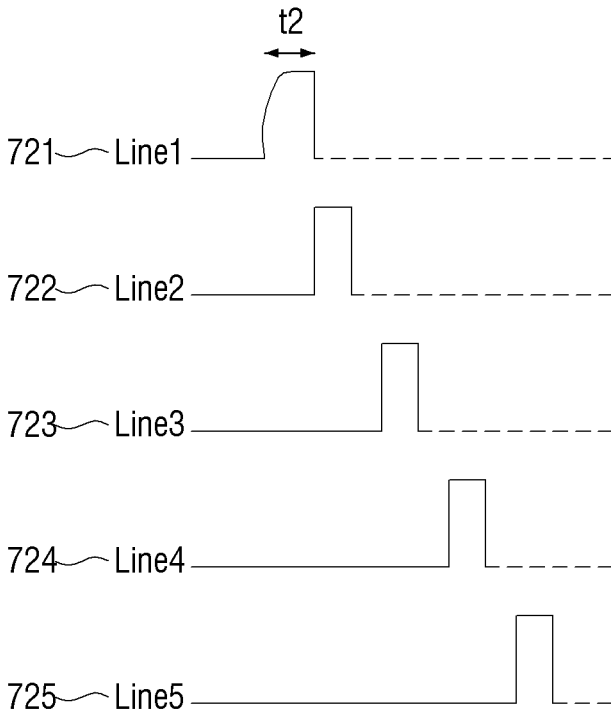

In other words, as illustrated in FIG. 8B, the processor 130 may increase the dimming time from t1 to t2 according to the compensated gray level. That is, the current may be applied for the time t2 for the first scan line 721, and the current may be applied for the time t1 for the remaining scan lines 722 to 724 so that the gray levels of the images of the first scan line 721 and the remaining scan lines 722 to 724 can be displayed differently. In this example, all of the scan lines 721 to 724 within the brighter gray level area 720 are displayed to have the same gray level, that is, the same brightness, to the user according to the influence of the parasitic capacitance described above.

Hereinafter, an example method for compensating for the gray level of the image according to an example embodiment will be explained.

Figure 9:
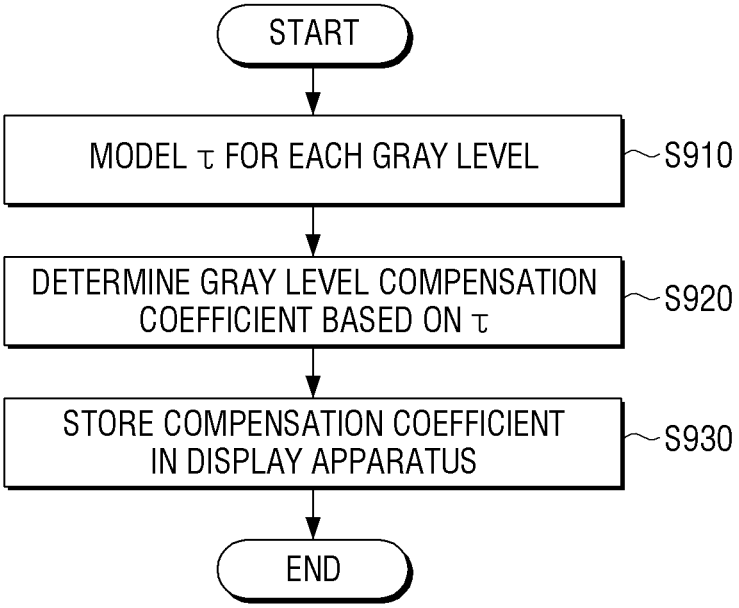
FIGS. 9, 10A, 10B, 10C, 10D, and 10E are diagrams illustrating a method for calculating compensation coefficient according to an example embodiment.

FIG. 9 is a flowchart illustrating a method for calculating a compensation coefficient according to an example embodiment.

As illustrated in FIG. 9, the calculation of the compensation coefficient may be performed in a processor or the like of the external device.

According to FIG. 9, first, the time constant τ for each gray level is modeled at operation S910.

Figure 10A:
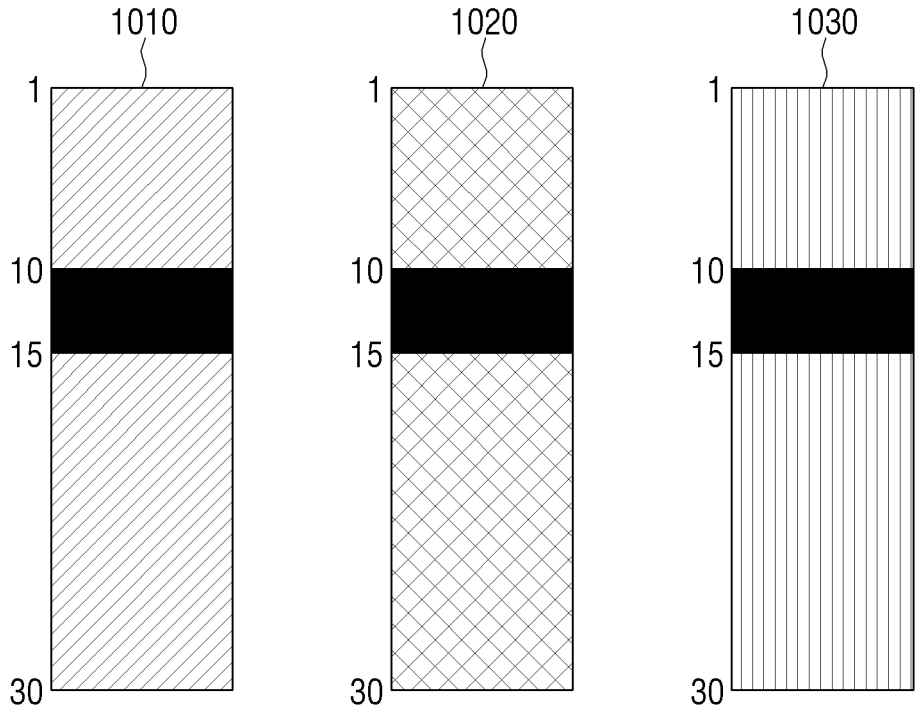

For example, as illustrated in FIG. 10A, it is possible to model the time constant τ according to the increase of the scan line by displaying an image of a specific gray level for each sub pixel. In the illustrated example embodiment, the first image 1010 includes a red image from the first line to the tenth line, a black image from the 11th line to the 15th line, and a red image from the 16th line to the 30th line. The second image 1020 includes a green image from the first line to the tenth line, a black image from the 11th line to the 15th line, and a green image from the 16th line to the 30th line. The third image 1030 includes a blue image from the first line to the tenth line, a black image from the 11th line to the 15th line, and a blue image from the 16th line to the 30th line.

Figure 10B:
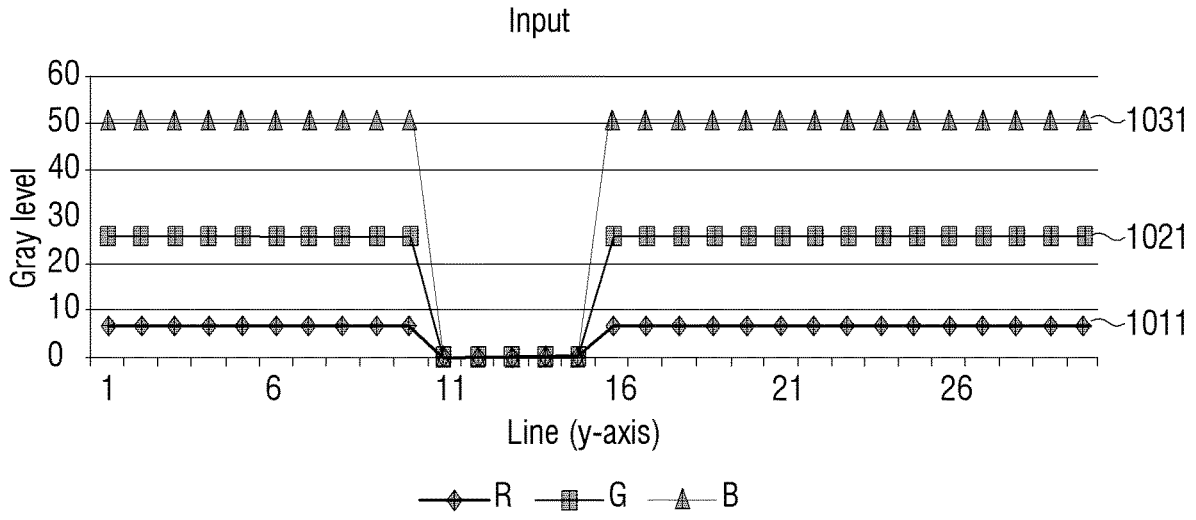

In this example, the input signal may be a form illustrated in FIG. 10B. In FIG. 10A, it is assumed that the respective gray levels of the first to third images 1010 to 1030 are different. As shown in FIG. 10B, the input gray level 1011 may correspond to the first image 1010, the input gray level 1021 may correspond to the second image 1020, and the input gray level 1031 may correspond to the third image 1030.

Figure 10C:
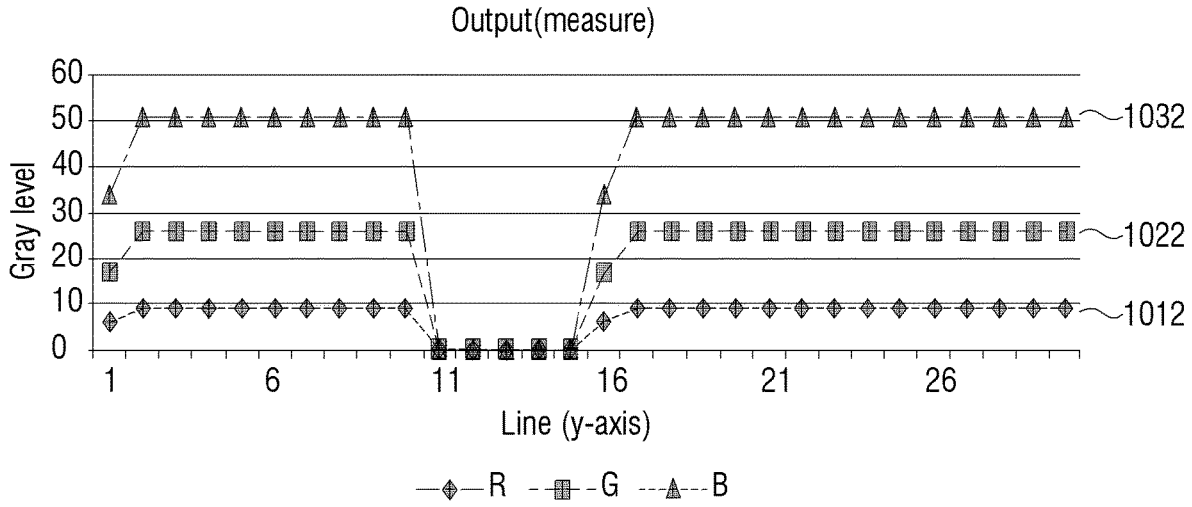

In this example, the output gray levels of the first to third images 1010 to 1030 are as illustrated in FIG. 10C due to the influence of the parasitic capacitance described above. That is, the first and 16th lines of each of the first to third images 1010 to 1030 have no parasitic capacitance charged in the previous line and the output luminance is lower than other lines displaying the same gray level. As shown in FIG. 10C, the output gray level 1012 may correspond to the first image 1010, the output gray level 1022 may correspond to the second image 1020, and the output gray level 1032 may correspond to the third image 1030.

To solve the problem, the influence of the parasitic capacitance in each of the lines may be modeled.

Figure 10D:
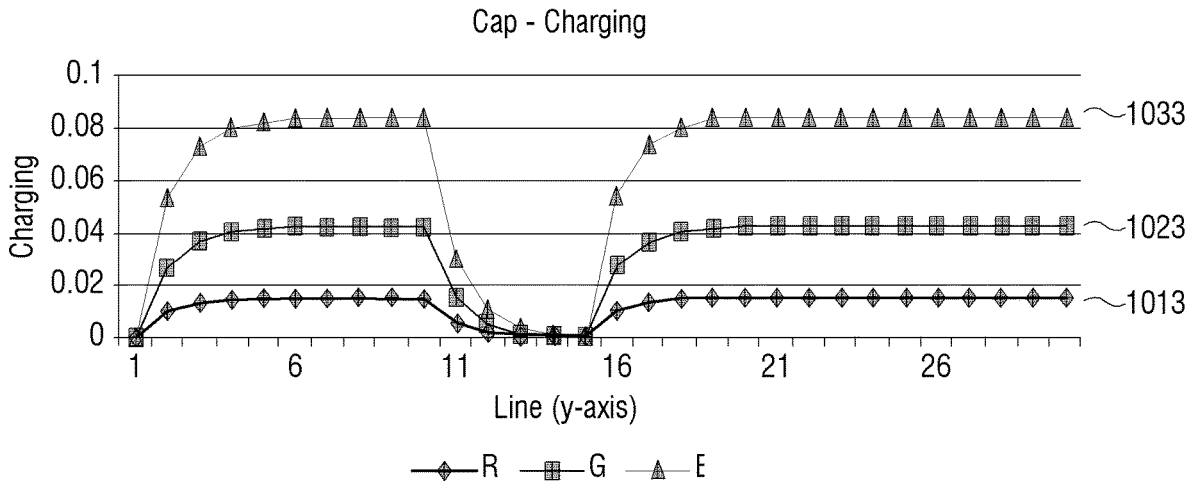

For example, the influence of the parasitic capacitance in each line may be modeled in the form illustrated in FIG. 10D. In other words, the parasitic capacitance charged in the LED of each line and affecting at least one subsequent line gradually increases to reach a normal state, so that the parasitic capacitance in the LED of each line can be modeled as a time constant τ. As shown in FIG. 10D, the parasitic capacitance 1013 may correspond to the first image 1010, the parasitic capacitance 1023 may correspond to the second image 1020, and the parasitic capacitance 1033 may correspond to the third image 1030.

For example, the parasitic capacitance gradually increases in the order of the first line, the second line and the third line to reach the normal state by the fourth line. Subsequently, since the current is not applied to the LED element from the eleventh line in which the black image is displayed, the charged parasitic capacitance gradually discharges to reach the normal state in the 13th line, and thereafter gradually increases from the sixteenth line to reach the normal state by the 19th line.

Figure 10E:
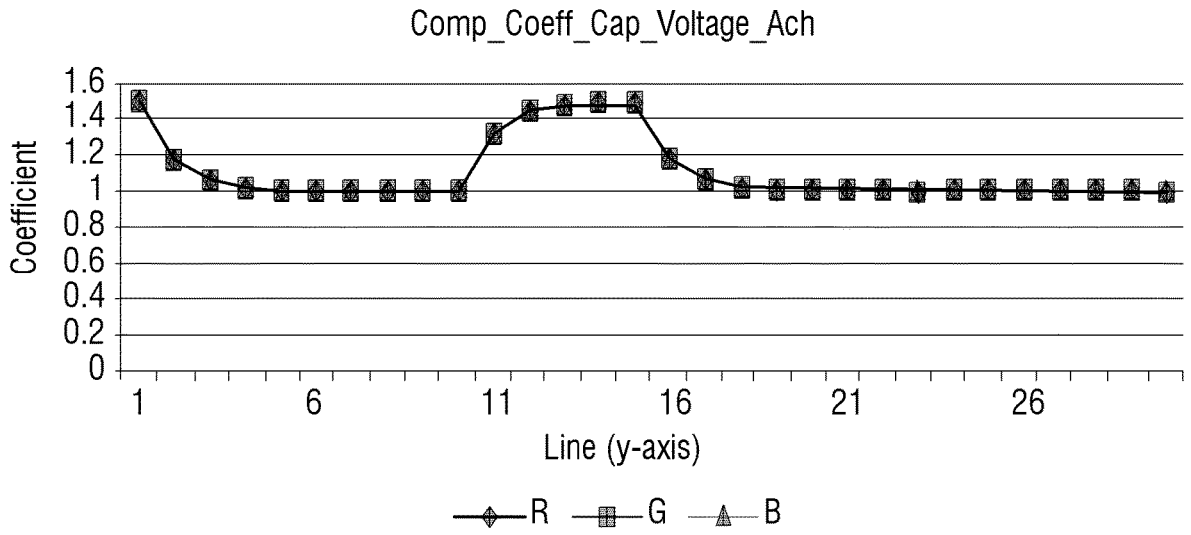

Subsequently, the time constant τ-based gray level compensation coefficient is determined at operation S920. That is, as illustrated in FIG. 10D, when the influence of the parasitic capacitance in each line is modeled in the form of the time constant τ, the time constant τ-based gray level compensation coefficient in each line is calculated as illustrated in FIG. 10E based on the time constant τ. In other words, a gain value for compensating for the gray level due to the influence of the parasitic capacitance in each line may be calculated.

For example, in FIG. 10E, the compensation coefficient for the gray level of the first line with respect to the gray level 50 of blue LED may be about 1.5, the compensation coefficient for the gray level of the second line may be about 1.2, and the compensation coefficient for the gray level of the third line may be about 1.1. Thus, the compensation coefficient can be calculated for each gray level of each line.

Herein, the compensation coefficient may be calculated in the form of a gain value. For example, the compensation coefficient 1.5 with respect to the gray level of the blue LED of the first line can be calculated as 50/33 when the input gray level is 50 and the output gray level is 33.

The compensation coefficient thus calculated can be a compensation coefficient for each line with respect to the gray level 50 of the blue LED. However, the compensation coefficient in each line for the red LED and the green LED may be a value which is almost similar to the compensation coefficient in each line with respect to the blue LED. This is because the difference in dimming time is not large when the gray level difference is not large and the amount of the parasitic capacitance charged during the dimming time is not large.

However, in the case where the gray level difference is large, the compensation coefficient value can be changed because the difference in dimming time is large when the gradation difference is large and the amount of parasitic capacitance charged during the dimming time is large.

For example, the compensation coefficient for the gray level of the first line with respect to the gray level 10 of red LED may be about 1.5, the compensation coefficient for the gray level of the second line may be about 1.2, and the compensation coefficient for the gray level of the third line may be about 1.1. For example, the compensation coefficient 1.5 with respect to the gray level 8 of the red LED of the first line can be calculated as 8/5.3 when the output gray level is about 5.3.

In addition, the compensation coefficient can be calculated for each gray level or each gray level change. In addition, a separate compensation coefficient can be calculated also depending on the number of scan lines in which the same gray level is displayed. Further, a separate compensation coefficient can be calculated according to various environments that may affect the parasitic capacitance.

Subsequently, the calculated compensation coefficient is stored in the display apparatus 100 in operation S930. In other words, the compensation coefficient calculated in an external electronic apparatus, etc. may be provided to the display apparatus 100, or may be transmitted to the display apparatus 100 through a communicator of the external apparatus and stored in the display apparatus 100.

Herein, the compensation coefficient may be stored in various types such as a graph form, a look-up table form, and so on, as illustrated in FIG. 10E.

The calculation of the compensation coefficient illustrated in FIG. 9 may be performed by the external electronic apparatus (e.g., a personal computer (PC)). For example, the external electronic apparatus may analyze an image photographed by a colorimeter, a color difference meter, and the like to calculate a time constant τ-based gray level compensation coefficient. The calculated compensation coefficient may be transmitted to the display apparatus 100 and stored in the display apparatus 100. However, in some examples, an external apparatus may be provided with a camera to generate a photographed image on its own.

Figure 11:
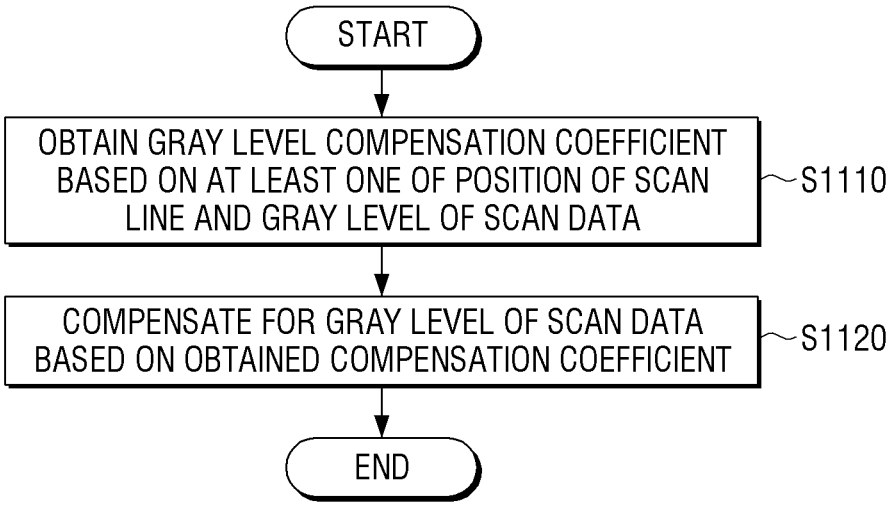
FIGS. 11, 12A and 12B are diagrams illustrating a gray level compensation method of a display apparatus according to an example embodiment.

FIG. 11 is a flowchart illustrating a gray level compensation method of the display apparatus according to an example embodiment.

According to the gray level compensation method of the display apparatus illustrated in FIG. 11, when an image is input, a gray level compensation coefficient is obtained based on at least one of the position of the scan line and the gray level of the scan data, at operation S1110. Subsequently, the gray level of the scan data is compensated based on the obtained compensation coefficient, at operation S1120.

For example, when the third image 1030 of FIG. 10A is input, the gray level of the scan data of each scan line may be compensated based on the gray level compensation coefficient of FIG. 10E. In other words, the compensated input gray level corresponding to the gray level 1031 of the input signal corresponding to the third image 1030 of FIG. 10A may be in the form of the third graph 1231 of FIG. 12A.

In addition, when the second image 1020 of FIG. 10A is input, the gray level of the scan data of each scan line may be compensated based on the gray level compensation coefficient of FIG. 10E. In other words, the compensated input gray level for the gray level 1021 of the input signal corresponding to the second image 1020 of FIG. 10A may be in the form of the second graph 1221 of FIG. 12A.

In addition, when the first image 1010 of FIG. 10A is input, the gray level of the scan data of each scan line may be compensated based on the gray level compensation coefficient of FIG. 10E. In other words, the compensated input gray level based on the gray level 1011 of the input signal shown in FIG. 10B corresponding to the first image 1010 of FIG. 10A may be in the form of the first graph 1211 of FIG. 12A.

Figure 12A:
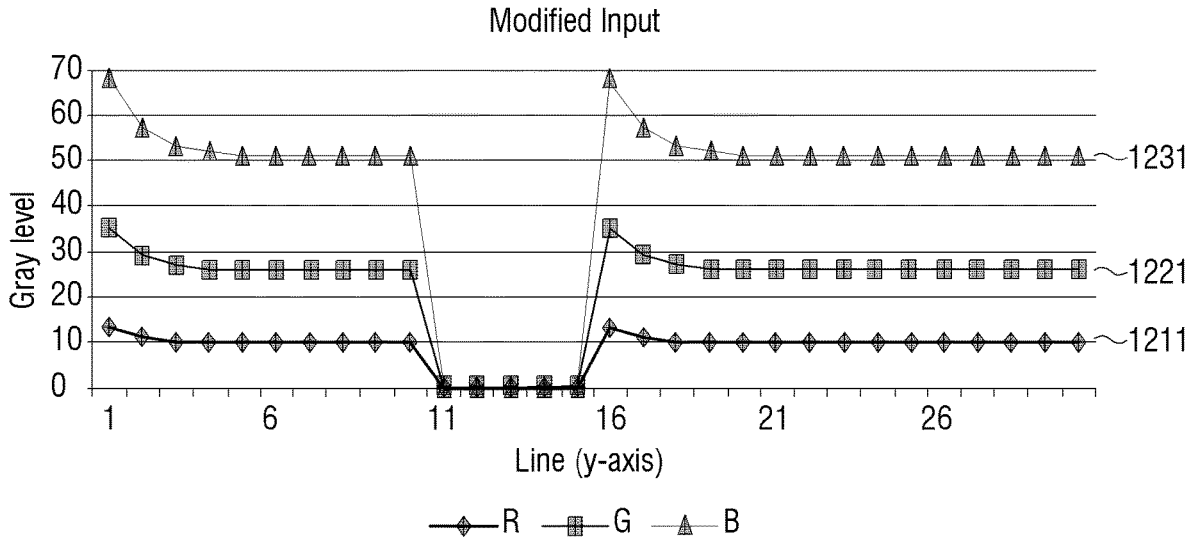
Figure 12B:
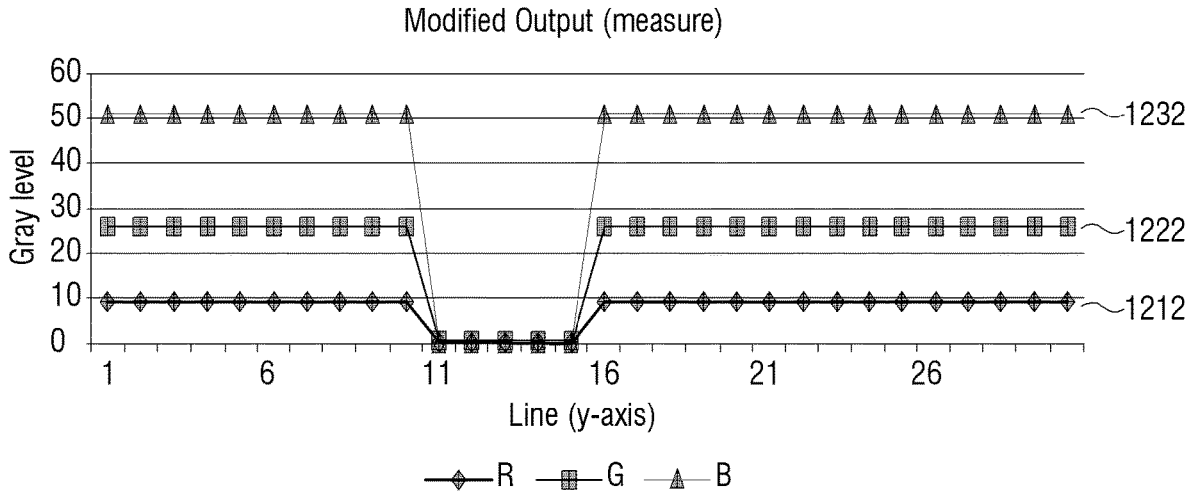

The output gray level corresponding to the compensated input gray level as illustrated in FIG. 12A becomes the form as illustrated in FIG. 12B, thereby preventing the first line and the 16th line from being outputted dark. As shown in FIG. 12B, the output gray level in the third graph 1232 may correspond to the compensated input gray level in the third graph 1231, the output gray level in the second graph 1222 may correspond to the compensated input gray level in the second graph 1221, and the output gray level in the first graph 1212 may correspond to the compensated input gray level of the first graph 1211.

FIG. 12A illustrates an example of an input signal, and the gradation of an input signal can be compensated based on a compensated gray level pre-calculated for various input signal gray levels.

As described above, according to various example embodiments, it is possible to compensate for the luminance reduction due to the influence of the parasitic capacitance.

As described above, according to various example embodiments, the power consumption of the display apparatus can be reduced while maintaining the luminance quality.

The methods according to various example embodiments described above can be implemented by the existing display apparatus and application installable in an external apparatus.

The methods according to various example embodiments described above can be implemented by only software/hardware upgrade for existing display apparatus.

In addition, the various example embodiments described above may also be performed through an embedded server provided in a display apparatus, or an external server.

Further, a non-transitory computer readable medium recording therein a program or a program code that may be executed by a computer or processor to sequentially perform a control method according to example embodiments may be provided.

The aforementioned control methods according to the various example embodiments may be implemented as a program code executable by a computer, and the code may be stored in a non-transitory computer-readable medium to be executed by the processor, and provided in a display apparatus or an external apparatus.

The non-transitory computer readable medium may refer to a medium that stores data semi-permanently rather than storing data for a very short time, such as a register, a cache, a memory or etc., and is readable by an apparatus. In detail, the above-described various applications or programs may be stored in the non-transitory computer readable medium, for example, a compact disc (CD), a digital versatile disc (DVD), a hard disc, a Blu-ray disc, a universal serial bus (USB), a memory card, a read only memory (ROM), and the like, and may be provided.

For example, at least one of these components, elements, modules or units may use a direct circuit structure, such as a memory, a processor, a logic circuit, a look-up table, etc. that may execute the respective functions through controls of one or more microprocessors or other control apparatuses.

What is claimed is:

1. A display apparatus comprising:

a display panel comprising a plurality of scan lines comprising a plurality of light emitting elements, each light emitting element comprising a light emitting diode (LED) corresponding to a sub pixel;

a storage configured to store a plurality of compensation coefficients corresponding to a plurality of gray levels; and a processor configured to:

determine a scan line for compensation from among the plurality of scan lines, obtain a compensation coefficient corresponding to a gray level of image data of the scan line, from among the plurality of compensation coefficients, compensate the gray level of the image data of the scan line by increasing the gray level of the image data of the scan line based on the obtained compensation coefficient, and drive LEDs of the scan line based on the compensated gray level, wherein a luminance of LEDs of an adjacent scan line disposed next to the scan line based on a current being applied to the adjacent scan line is higher than a luminance of the LEDs of the scan line based on a current being applied to the scan line by a parasitic capacitance of the LEDs of the scan line, and wherein the parasitic capacitance is a charge storage capacitance generated in the LEDs of the scan line based on forward bias being applied to the LEDs of the scan line.

2. The display apparatus as claimed in claim 1, wherein the processor is configured to determine a difference between the gray level of the image data of the scan line and a gray level of image data of the adjacent scan line, and based on the determined difference being larger than a threshold value, determine the scan line as the scan line for compensation, and wherein the processor is configured to determine a first scan line from among the plurality of scan lines as the scan line for compensation, regardless of a gray level of image data of the first scan line.

3. The display apparatus as claimed in claim 2, wherein the plurality of light emitting elements comprises a plurality of light emitting diodes (LEDs) divided into a plurality of LED areas, wherein the processor comprises a plurality of LED drivers for driving the plurality of LED areas, and wherein the processor is further configured to obtain the compensation coefficient from the storage corresponding to the gray level of the image data of the scan line of an LED area from among the plurality of LED areas.

4. The display apparatus as claimed in claim 1, wherein the light emitting element comprises a plurality of sub pixels, and wherein the processor is further configured to compensate the gray level of the image data of the scan line based on a compensation coefficient corresponding to each of the plurality of sub pixels.

5. A method of controlling a display apparatus which comprises display panel comprising a plurality of scan lines comprising a plurality of light emitting elements and stores a plurality of compensation coefficients corresponding to a plurality of gray levels, each light emitting element comprising a light emitting diode (LED) corresponding to a sub pixel, the method comprising:

determining a scan line for compensation from among the plurality of scan lines, obtaining a compensation coefficient corresponding to a gray level of image data of the scan line from among the plurality of compensation coefficients;

compensating the gray level of the image data of the scan line by increasing the gray level of the image data of the scan line based on the obtained compensation coefficient;

driving LEDs of the scan line based on the compensated gray level, wherein a luminance of LEDs of an adjacent scan line disposed next to the scan line based on a current being applied to the adjacent scan line is higher than a luminance of the LEDs of the scan line based on a current being applied to the scan line by a parasitic capacitance of the LEDs of the scan line, and wherein the parasitic capacitance is a charge storage capacitance generated in the LEDs of the scan line based on forward bias being applied to the LEDs of the scan line.

6. The method as claimed in claim 5, further comprising:

wherein the determining comprises determining a difference between the gray level of the image data of the scan line and a gray level of image data of the adjacent scan line, and based on the determined difference being larger than a threshold value, determine the scan line as the scan line for compensation, and wherein the determining comprises determining a first scan line from among the plurality of scan lines as the scan line for compensation, regardless of a gray level of image data of the first scan line.

7. The method as claimed in claim 5, wherein the plurality of light emitting elements comprises a plurality of light emitting diodes (LEDs) divided into a plurality of LED areas, wherein the plurality of LED areas are driven by a plurality of LED drivers, and wherein the gray level of the image data of the scan line of an LED area of the plurality of LED areas.

8. The method as claimed in claim 5, wherein the light emitting element comprises a plurality of sub pixels, and wherein the compensating the gray level of the image data of the scan line comprises compensating the gray level of the image data of the scan line based on a compensation coefficient corresponding to each of the plurality of sub pixels.

* * * * *